US007387299B1

(12) United States Patent
Voden

(10) Patent No.: US 7,387,299 B1
(45) Date of Patent: Jun. 17, 2008

(54) COLLAPSIBLE GAME TABLE

(76) Inventor: Justin L. Voden, W244 S6945 Maple Hill Dr., Waukesha, WI (US) 53189

( * ) Notice: Subject to any disclaimer, the term of this patent is extended or adjusted under 35 U.S.C. 154(b) by 88 days.

(21) Appl. No.: 10/908,426

(22) Filed: May 11, 2005

Related U.S. Application Data

(63) Continuation-in-part of application No. 10/710,171, filed on Jun. 23, 2004, now Pat. No. 7,156,396.

(51) Int. Cl.
*A63F 3/00* (2006.01)

(52) U.S. Cl. ..... 273/285; 273/309

(58) Field of Classification Search ..... 273/283, 273/284, 285, 309
See application file for complete search history.

(56) References Cited

U.S. PATENT DOCUMENTS 1,445,566 A * 2/1923 Stoll ..... 190/11
3,156,467 A * 11/1964 Rucker ..... 273/126 R
3,792,668 A * 2/1974 Ward ..... 108/69
3,964,403 A 6/1976 Schankman
4,015,778 A * 4/1977 Chen et al. ..... 273/284
4,041,880 A 8/1977 Schankman
4,354,685 A * 10/1982 Hampson ..... 273/342
4,579,342 A 4/1986 Mortensen
4,927,140 A 5/1990 Pappas
5,078,404 A 1/1992 Barillaro et al.
5,362,063 A 11/1994 Cummings
6,041,722 A 3/2000 Baker
6,616,141 B2 9/2003 Diamant
6,634,646 B2 10/2003 Wolpert et al.
6,926,278 B2 * 8/2005 Bibi ..... 273/284

* cited by examiner

*Primary Examiner*—Vishu K. Mendiratta
(74) *Attorney, Agent, or Firm*—Ziolkowski Patent Solutions Group, SC

(57) ABSTRACT

A folding game table having a collapsible construction is disclosed. The folding game table has a plurality of table top portions connected with at least one hinge and movable between an extended position and a folded position. At least one retention coupler is configured to be removably secured to the plurality of table top portions and configured to removably attach at least one table inlay to the plurality of table top portions.

13 Claims, 9 Drawing Sheets

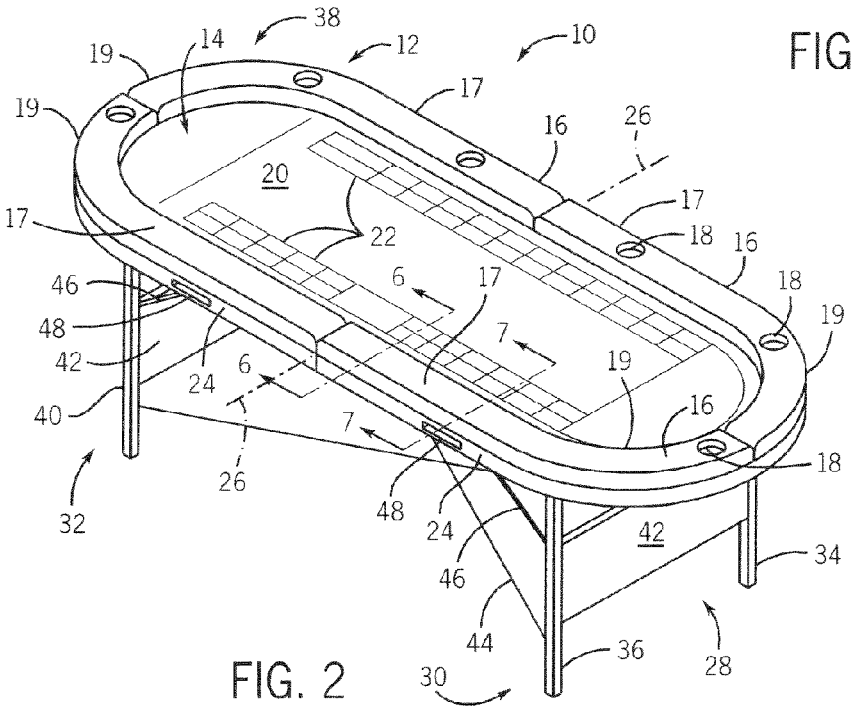
FIG. 1
FIG. 2
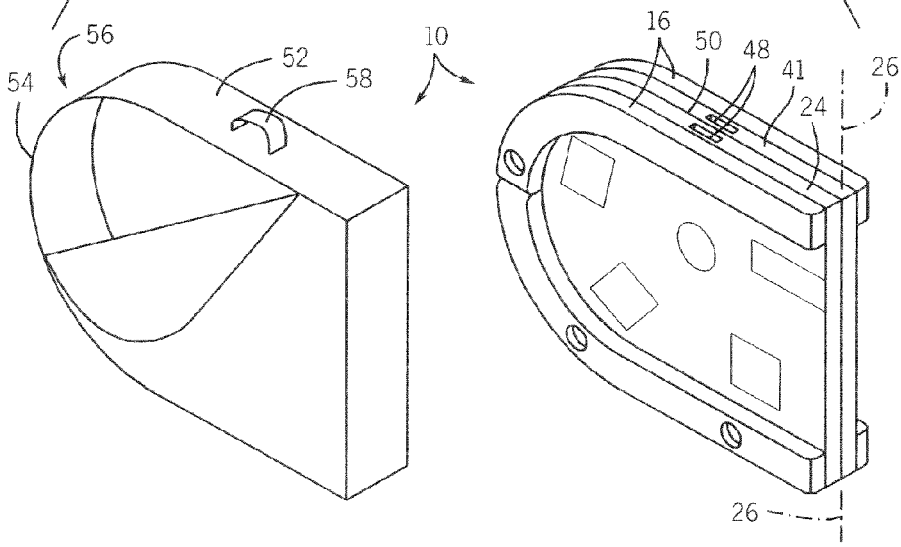

10
12
16
16
20A
62
70
62
70
22
62
62
70
20B
20
64
64
68
62
70
60
68
14
64
24
64
60
64
60
68
64
64
24
66
68

FIG. 9
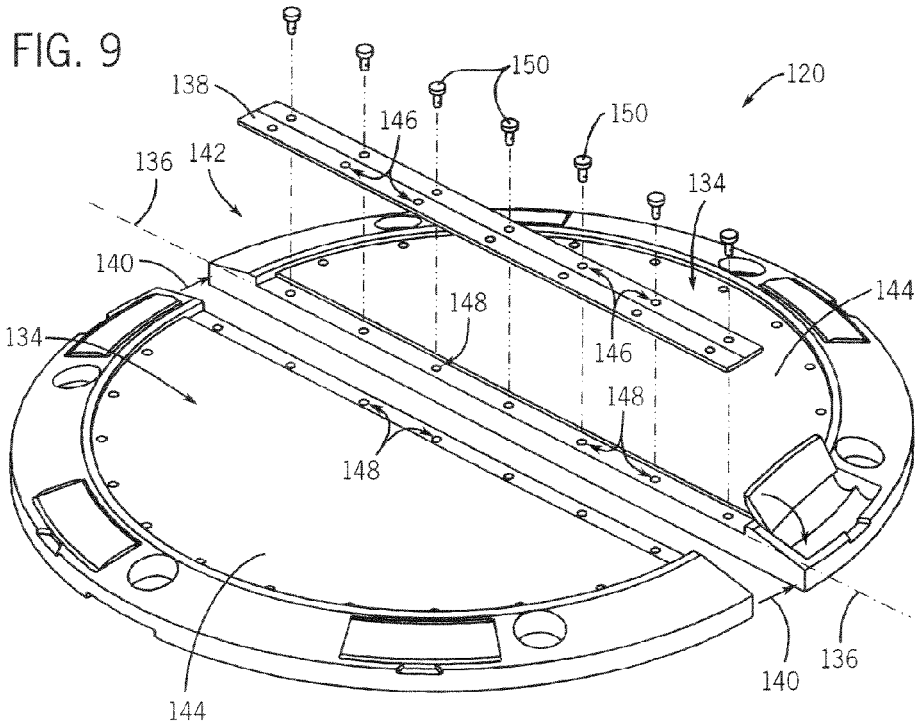
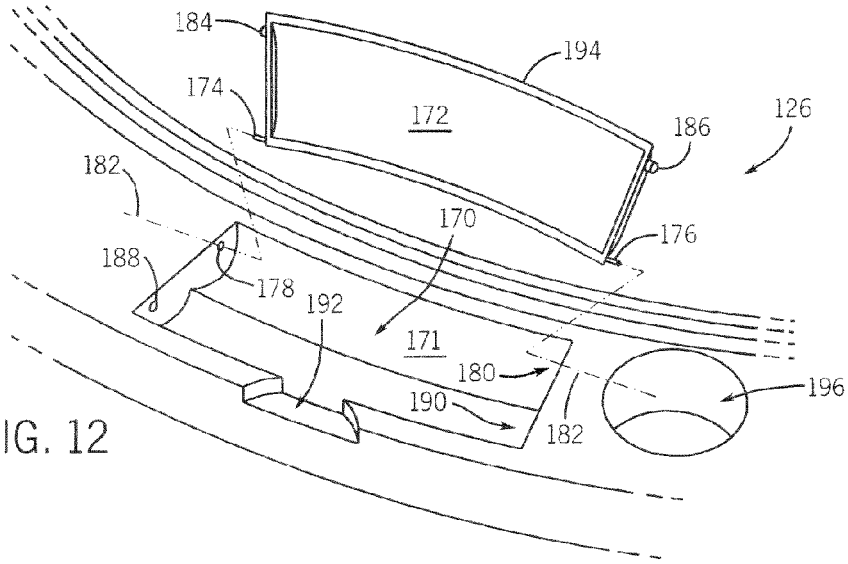
FIG. 12

COLLAPSIBLE GAME TABLE

CROSS REFERENCE TO RELATED APPLICATIONS

The present application is a continuation-in-part and claims priority of U.S. Ser. No. 10/710,171 filed Jun. 23, 2004.

BACKGROUND OF THE INVENTION

The present invention relates generally to game tables and, more particularly, to a multi-game collapsible game table.

Poker tables generally consist of a relatively flat surface with a felt or comparable material positioned thereover. In order to maintain the quality and condition of the cover material of the table as well as reduce any obstructions to game play, players often prefer some additional space away from the play surface for food and drink as well as poker chips or other win/loss indicators. Additionally, ancillaries associated with game play such as cards, dice, poker chips, and the like, should preferably be kept with the table in order to keep these related game-playing elements from being misplaced.

Another consideration of game table design is the collapsibility of the table system. These tables are often only used periodically and are frequently set up for game time and collapsed and stored shortly thereafter. It is often desirable to store the table in a minimum of space compared to the amount of space occupied by the table when it is set up.

Another consideration of game table design is game format. The game format is the table inlay or indicia provided on the game playing surface to aid in game flow. Several game formats that can be provided on the game playing surface include a roulette, craps, poker, cricket, dog track, and blackjack to name but a few. A variety of table inlays, each including distinct game indicia, positionable on the play surface provide for a multi-use game table.

It would therefore be desirable to have a game table and method of altering a game format that is quickly and simply collapsible and provides a plurality of interchangeable game formats.

BRIEF DESCRIPTION OF THE INVENTION

The present invention is directed to a folding game table that solves the aforementioned problems. The game table has a plurality of table top portions pivotably connected to be movable between an extended position and a folded position. A table inlay is interchangeably secured across a play surface of the game table.

Therefore, in accordance with one aspect of the present invention, a folding game table is disclosed that includes a plurality of table top portions and at least one hinge connecting the plurality of table top portions and configured to permit each of the plurality of table top portions to move between an extended position and a folded position. The folding game table also includes at least one table inlay and at least one retention coupler configured to removably attach the at least one table inlay to the plurality of table top portions.

In accordance with another aspect of the present invention, a table-top apparatus for playing multiple games is disclosed that includes a pair of table sections, means for connecting the pair of table sections to form a foldable table top, and a game mat. The apparatus also includes a coupler assembly engageable about a perimeter of the game mat and constructed to removably secure the game mat to the foldable table top.

In accordance with a yet another aspect of the present invention, a portable game table includes a first table member and a second table member pivotably attached to the first table member, the first and second table members moveable between an extended position and a collapsed position. A first rail is positioned about an edge of the first table member, and a second rail is positioned about an edge of the second table member. The portable game table includes at least one storage tray formed in at least one of the first rail and the second rail, the at least one storage tray having a lid pivotably attached thereabout, the lid having a closed position and an open position.

Various other features, objects and advantages of the present invention will be made apparent from the following detailed description and the drawings.

BRIEF DESCRIPTION OF THE DRAWINGS

The drawings illustrate one preferred embodiment presently contemplated for carrying out the invention.

In the drawings:

FIG. 1 is a perspective view of a collapsible game table according to the present invention shown in an extended position.

FIG. 2 is a perspective view of the game table shown in FIG. 1 in a collapsed position with an accompanying case.

FIG. 9 is a perspective view of the game table partially exploded of FIG. 8 illustrating a hinge assembly.

FIG. 12 is a perspective view of an accessory bin of the game table of FIG. 8 having a cover exploded therefrom.

DETAILED DESCRIPTION OF THE PREFERRED EMBODIMENT

Figure 3:
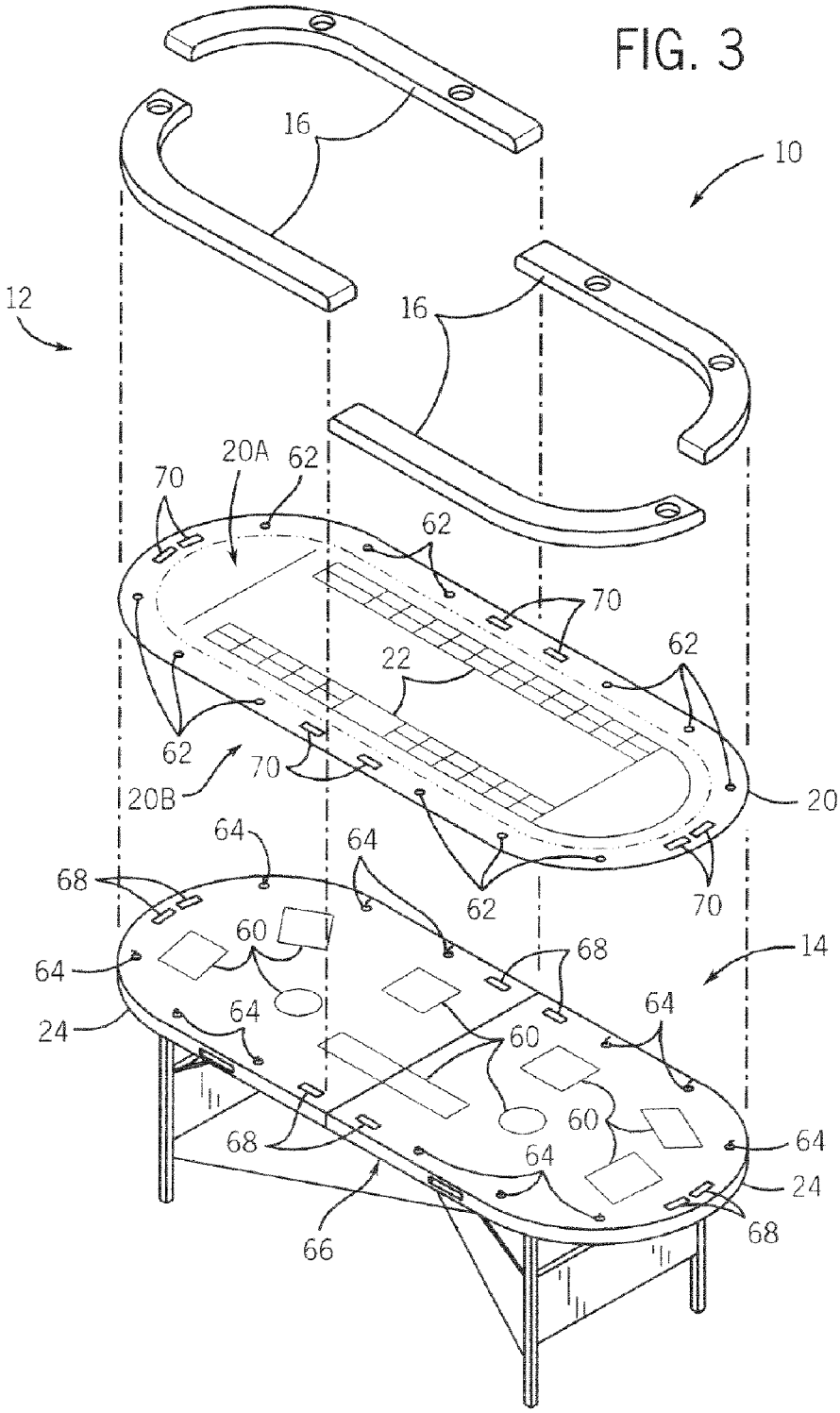
FIG. 3 is a perspective exploded view of the game table shown in FIG. 1.

FIG. 1 shows a game table 10 having a rail 12 positioned about a play surface 14. Rail 12 includes a plurality of individual rail sections 16 that cooperate to encompass play surface 14. In a preferred embodiment, four rail sections 16 are combined to form a cushioned rail 12 that encloses play surface 14. Each rail section 16 has a generally straight portion 17 and a generally curved portion 19. The generally straight portion 17 of each rail section 16 abuts the generally straight portion 17 of an adjoining rail section 16, and the generally curved portion 19 of each rail section 16 abuts the generally curved portion 19 of another adjoining rail section 16. Such cooperation effectively encircles play surface 14. A plurality of recesses 18 is formed in rail 12 and configured to provide game players with a storage location for game play ancillaries such as poker chips and/or drinks. Providing player positioning of drinks and chips off of play surface 14 improves the flow of the game and maintains the cleanliness of play surface 14. A table inlay 20 is positioned on play surface 14 and may include game indicia 22 thereon. Game indicia 22 include a wide variety of markings associated with game play. Such indicia can include, for example, patterns associated with roulette, blackjack, craps, and poker, to name but a few. However, table inlay 20 may be blank and have no indicia markings thereon.

Game table 10 includes a pair of table top sections 24 pivotably connected about a hinge axis 26. A leg assembly 28 includes a first set of legs 30 and a second set of legs 32 generally disposed at opposite ends of game table 10. Each set of legs 30, 32 includes a pair of legs 34, 36 and 38, 40, respectively. A brace 42 extends between legs 34, 36, 38, 40 of each set of legs 30, 32. A strap 44, or cable, extends under game table 10 between diagonally opposite legs of leg assembly 28. Such an orientation reduces interference of strap 44 with players positioned about game table 10 and forms a relatively robust support system of game table 10.

A bracket 46 extends between each set of legs 30, 32 and table top sections 24. Brackets 46 are constructed to allow each set of legs 30, 32 to be folded under table top sections 24 thereby collapsing game table 10 into a generally planar orientation without the legs extending perpendicularly therefrom. Additionally, a pocket 48 is formed into each table top section 24 generally proximate an axis of center of mass of each table top portion. The collapsed orientation of game table 10 is shown in FIG. 2.

As shown in FIG. 2, leg assembly 28 folds into table sections 24 and table sections 24 rotate together about hinge axis 26 thereby providing a folded table length that is half of the extended table length shown in FIG. 1. Additionally, when folded together, pockets 48 formed in table sections 24 align to form a handle 50 for easy and efficient handling of game table 10 in the collapsed position. A case 52 is also shown in FIG. 2 and is shaped to snuggly receive folded game table 10 therein. Case 52 includes a zipper 54 located about a perimeter 56 of the case 52 and is constructed to allow quick and efficient removal or insertion of game table 10 into case 52. An opening 58 is formed through case 52 and allows access to handle 50 when game table 10 is positioned in case 52. Alternative to forming opening 58 through case 52, a handle may be attached to case 52 to allow easy and efficient handling thereof.

FIG. 3 shows a perspective exploded view of game table 10. The plurality of individual rail sections 16 is detachably mounted to game table 10 to allow table inlay 20 to be positioned on, and removed from, game table 10. Table inlay 20 has two sides 20A and 20B, each side having game indicia 22 thereon allowing table inlay 20 to be turned over to reveal a different set of game indicia on the opposite side. Table inlay 20 is preferably made of a felt material, although materials such as leather, vinyl, and the like may be used. Additionally, table inlay 20 may be removed from play surface 14 to reveal game indicia 60 on table top sections 24 to allow game play on play surface 14 without table inlay 20 positioned thereon.

To mount table inlay 20 to game table 10, table inlay 20 is placed on play surface 14 with rail 12 removed from game table 10. A plurality of holes 62 is formed in table inlay 20 to allow table inlay 20 to be coupled to a plurality of table inlay retainers 64. Table inlay retainers 64 are preferably hooks, pins, or clips and are attached to game table 10 about a perimeter 66 of table top sections 24. In a preferred embodiment, table inlay 20 is stretched tightly over play surface 14 to minimize wrinkles or slack in table inlay 20. Table inlay retainers 64 preferably maintain a stretched or taut position of table inlay 20 over play surface 14. Rail 12 is connected to game table 10 over table inlay 20. A plurality of apertures 68 is formed in table top sections 24 and is discussed further below with respect to FIG. 6. Table inlay 20 has a plurality of latch openings 70 formed therein, each latch opening 70 substantially overlaps a corresponding aperture 68.

Table inlay 20 is removable for changing of game indicia 22 of side 20A and for folding of game table 10. Table inlay 20 may be removed from game table 10 by removing rails 16 from game table 10. With rails 16 removed, table inlay 20 may be de-coupled from table inlay retainers 64. Table inlay 20 can be turned over to reveal a different table inlay illustrated on the opposite side 20B or stored to expose game indicia 60.

Figure 4:
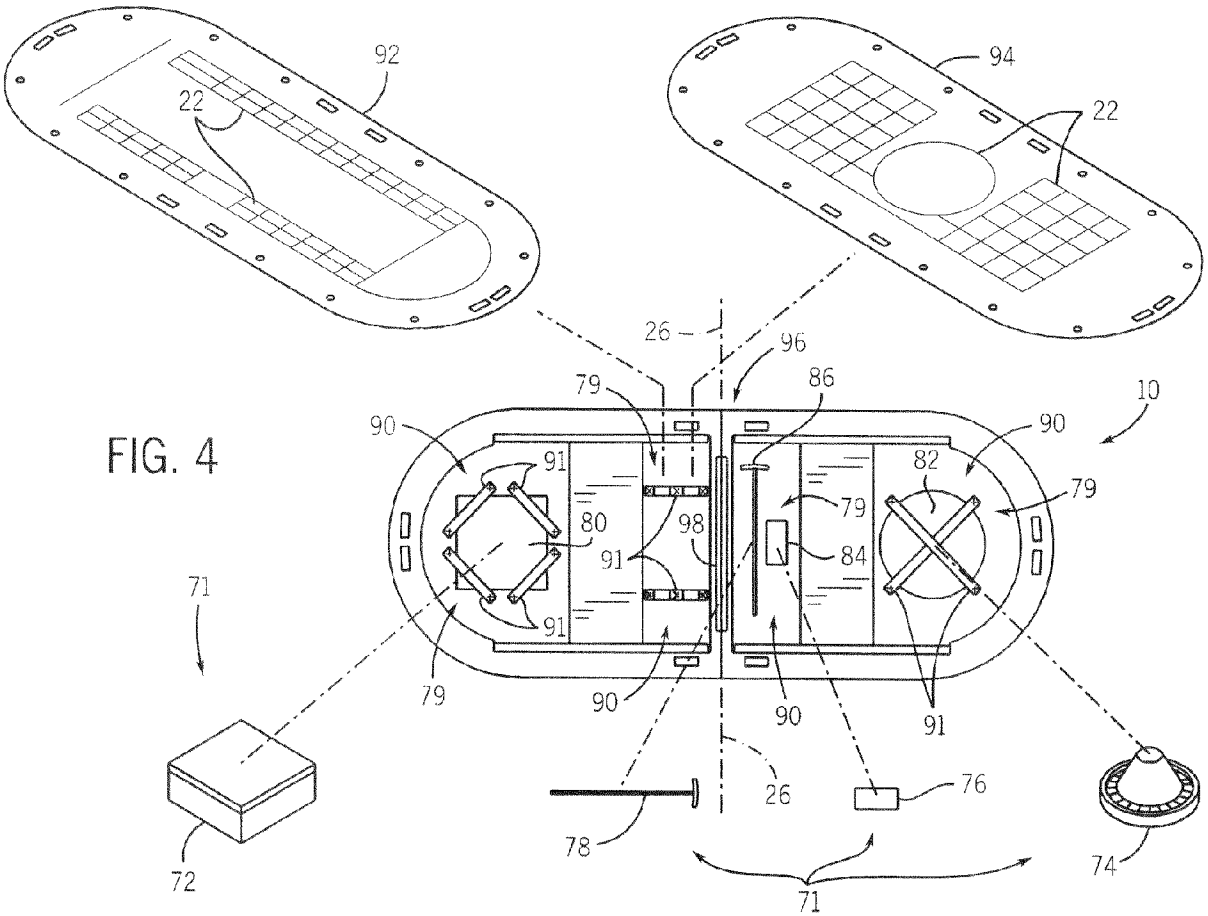
FIG. 4 is a bottom view of the game table shown in FIG. 1 with a variety of game accessories removed therefrom.

FIG. 4 shows a bottom view of game table 10 where a plurality of game accessories 71 may be stored when not in use. Examples of game accessories that may be required to play some of the games indicated by game indicia 22, 60 include: poker chips placed in box 72; a roulette wheel 74; dice, cards, roulette balls, and other items placed in box 76; and a craps stick 78. A plurality of storage locations 79 receives game accessories 71. Storage locations 79 are constructed to snuggly receive a respective game accessory 71 therein. Storage locations 79 include a square-shaped cavity 80 to receive box 72, a circle-shaped cavity 82 to receive roulette wheel 74, a rectangular-shaped cavity 84 to receive box 76, and a cavity 86 to receive craps stick 78. Furthermore, a cavity (not shown) may be formed in game table 10 to receive case 52 when game table 10 is removed therefrom. The game accessories and storage locations listed above are not intended to be a complete list of possible combinations usable with game table 10. Other game accessories and storage locations are within the scope of the claims.

A retaining system 90 is used to secure game accessories 71 in storage locations 79 of game table 10. Retaining system 90 includes a plurality of straps 91, for example, to secure box 72, roulette wheel 74, and table inlays 92, 94 in each respective storage location. Straps 91 may be made of a non-elastic material such as leather or webbing and may be connectable to game table 10 through the use of snaps, interlocking hook and loop fasteners, and the like. Straps 91 may also be made of an elastic material and may be permanently secured to game table 10. Retaining system 90 may also include forming the shapes of cavities 84 and 86 to closely match the shape of game accessories 76 and 78 such that friction secures game accessories 76 and 78 therein. Rubber, foam, or other similar material may also be placed in cavities 84 and 86 to secure the game accessories 76 and 78 therein. For example, rectangular-shaped cavity 84 may frictionally secure box 76 simply by pushing or pressing box 76 therein, and cavity 86 may frictionally secure craps stick 78 by pressing craps stick 78 into cavity 84.

FIG. 4 also shows a hinge assembly 96 attached to table top sections 24. Hinge assembly 96 connects table top sections 24 and allows table top sections 24 to pivot about hinge axis 26. Hinge assembly 96 may include a single hinge 98, as shown in FIG. 4, or multiple hinges 100 and 102, as shown in FIG. 5.

Figure 5:
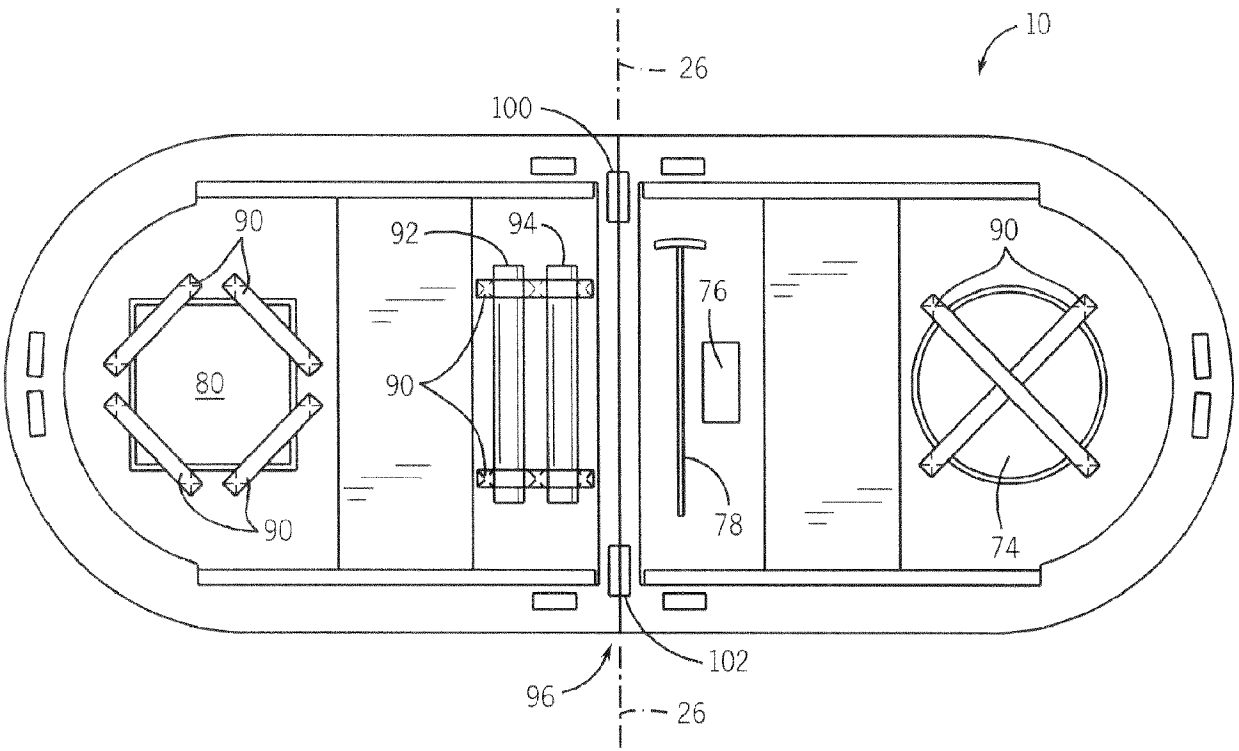
FIG. 5 is a bottom view of the game table shown in FIG. 4 with the game accessories positioned in the game table.

FIG. 5 shows game accessories 71 of FIG. 4 secured to game table 10 in each respective storage location 79. Box 72, roulette wheel 74, and table inlays 92, 94 are secured using straps 91. Cavities 84 and 86 are constructed to frictionally secure box 76 and craps stick 78 therein.

Figure 6:
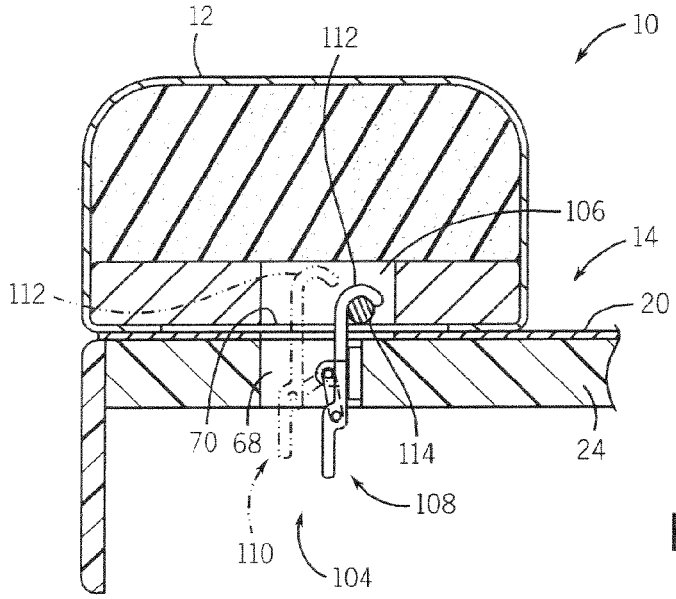
FIG. 6 is a cross-sectional side elevational view of a portion of the game table along line 6-6 of FIG. 1 showing a bumper latch assembly.

As previously referred to, FIG. 6 shows, in part, a cross-sectional view of aperture 68 of table top section 24. A latch assembly 104 is attached to game table 10 within aperture 68. Latch assembly 104 extends through latch opening 70 of table inlay 20 and into a latch cavity 106 formed in rail 12. Latch cavity 106 allows a hook end 112 of latch assembly 104 to pass therein. Latch assembly 104 is preferably a pivotable hook latch. Latch assembly 104 has a latched position 108 and an unlatched position 110. In the latched position 108, hook end 112 of latch assembly 104 engages a catch 114 attached to rail 12 and secures rail 12 to game table 10. In the unlatched position 110, hook end 112 of latch assembly 104 is disengaged from catch 114 such that rail 12 may be removed from play surface 14.

Figure 7:
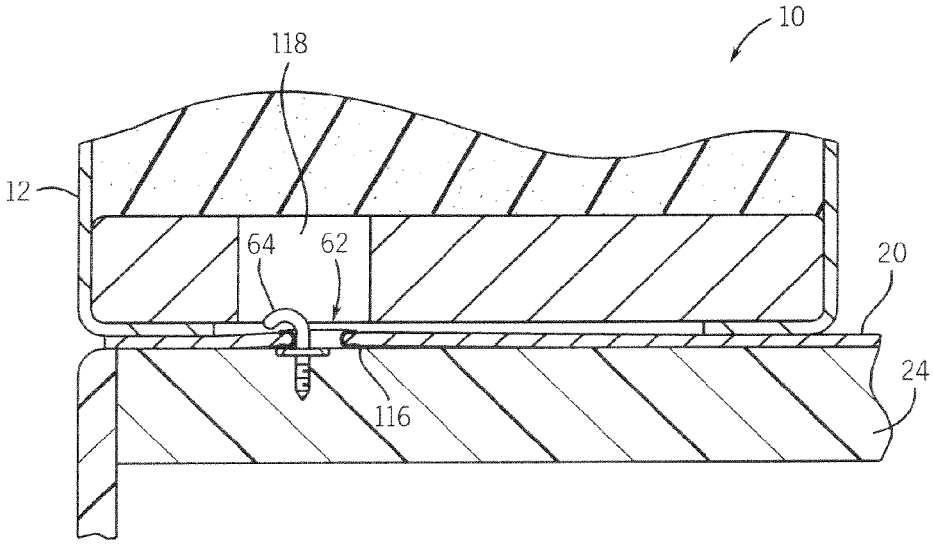
FIG. 7 is a cross-sectional side elevational view of a portion of the game table along line 7-7 of FIG. 1 showing a game template hook assembly.

FIG. 7 shows table inlay 20 secured to game table 10 with a table inlay retainer 64. Table inlay retainer 64 is mounted to game table 10 so as to securely maintain a stretched position of table inlay 20 when table inlay 20 is attached thereto. A grommet 116 is affixed to table inlay 20 about hole 62 and provides strength and support to the connection of table inlay 20 to table inlay retainer 64. In this manner, potential tearing or deformation of table inlay 20 is reduced. A cavity 118 is formed in rail 12 and allows table inlay retainer 64 to extend therein while allowing rail 12 to rest snuggly about table inlay 20.

Figure 8:
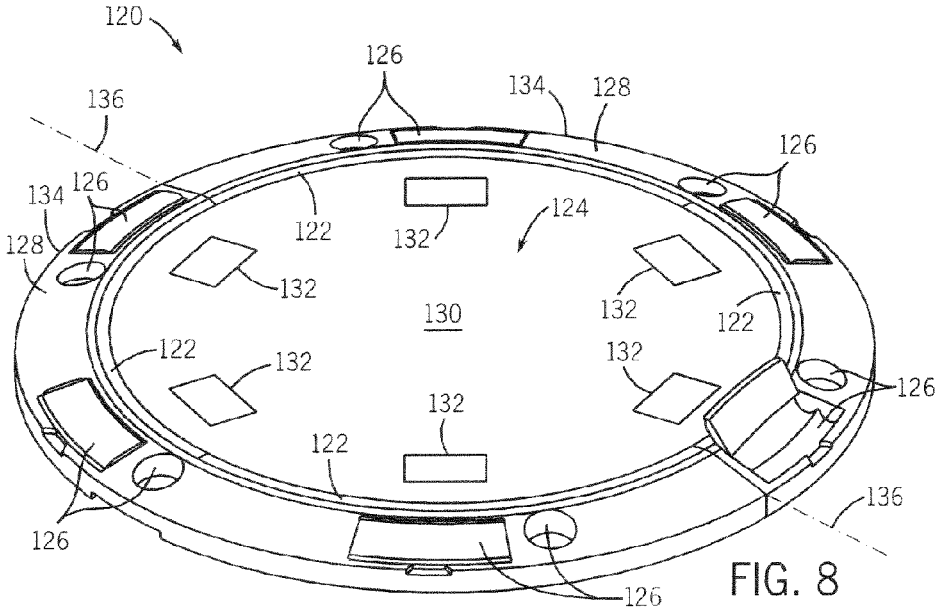
FIG. 8 is a perspective view of a collapsible game table shown in an extended position according to another embodiment of the present invention.

FIG. 8 shows another embodiment of the invention wherein a game table 120 is preferably constructed for placement on another table or set of legs. Game table 120 has a plurality of retention couplers 122 positioned about a play surface 124. Retention couplers 122 cooperate to encompass play surface 124. A plurality of recesses 126 is formed in an edge rail 128 of game table 120 to provide game players with a storage location for game play ancillaries such as poker chips and/or drinks. Preferably, a table inlay 130 is positioned on play surface 124 and may include game indicia 132 associated with a particular game to be played thereon. However, table inlay 130 may be blank and have no indicia markings thereon.

Game table 120 includes a pair of table top sections 134 pivotably connected about a rotation axis 136. As shown in FIG. 8, table top sections 134 are positioned in an open or extended position. In the extended position, game table 120 may be placed on another table or other supporting surface. In this manner, players may position themselves around the game table 120 for game play using game table 120. In a preferred embodiment, game table 120 is a circular table when positioned in the extended position; however, other shapes such as a hexagon and an octagon are possible and are within the scope of the appending claims. The shape of table inlay 130 and retention couplers 122 are selected to match the shape of game table 120. That is, a circularly-shaped table inlay 130 may be secured to a circularly-shaped game table 120 by retention couplers 122 collectively circular in shape.

FIG. 9 shows a perspective partially exploded view of game table 120. A hinge 138 connects table top sections 134 and allows table top section 134 to be positionable between an open or extended position and a collapsed position or folded position. Table top sections 134 are placed adjacent to one another 140, and hinge 138 is positioned in a hinge recess 142 formed between table top sections 134. Hinge recess 142 allows placement of hinge 138 therein such that hinge 138 is substantially flush with a table top surface 144. Each of a plurality of fastener apertures 146 formed in hinge 138 aligns with a corresponding fastener aperture 148 formed in table top sections 134. Fasteners 150 secure hinge 138 to table top sections 134. Hinge 138 lies along rotation axis 136 and allows rotation of table top sections 134 about rotation axis 136. In a preferred embodiment, hinge 138 is constructed of a non-elastic, flexible material such as webbing; however, other materials or objects such as a piano hinge or multiple butt hinges may be used and are within the scope of the appending claims.

Figure 10:
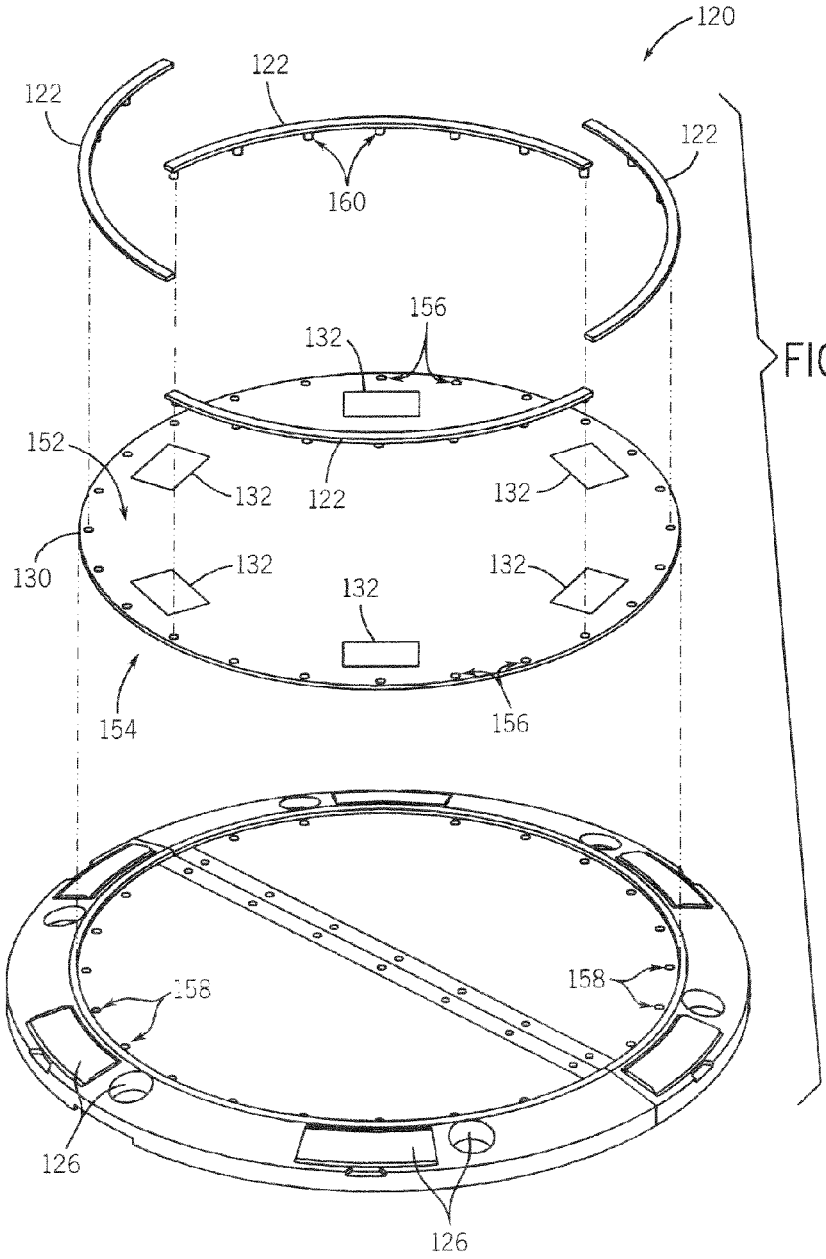
FIG. 10 is a perspective exploded view of the game table of FIG. 8.

FIG. 10 shows a perspective exploded view of game table 120. Retention couplers 122 detachably mount to game table 120 to allow table inlay 130 to be positioned on, and removed from, game table 120. Table inlay 130 has two sides 152 and 154, each side preferably providing different indicia 132 for playing different games. Table inlay 130 may, however, be blank on one or both sides 152, 154. Table inlay 130 may be turned over to reveal a different set of game indicia on the opposite side. Table inlay 130 is preferably made of a felt material, although other materials such as leather, vinyl, and the like are contemplated.

To mount table inlay 130 to game table 120, table inlay 130 is placed on play surface 124 with retention couplers 122 removed from game table 120. Each of a plurality of holes 156 formed in table inlay 130 aligns with a corresponding opening 158 formed in table top sections 134. Retention couplers 122 have a plurality of quick-connect fasteners 160 attached thereto. Each quick-connect fastener 160 aligns with a corresponding hole 156 and engages game table 120 via a corresponding opening 158. In a preferred embodiment, quick-connect fasteners 160 couple to game table 120 via snap fit connections. Retention couplers 122 secure table inlay 130 to game table 120 when coupled to game table 120.

Figure 11:
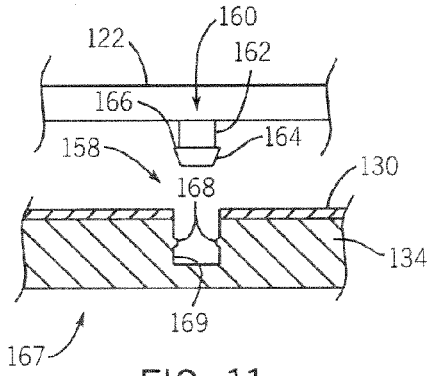
FIG. 11 is a side elevational view of an exploded portion of a removable retention coupler along line 11-11 of FIG. 8.

FIG. 11 is a side elevational view of a portion of a retention coupler 122 with a quick-connect fastener 160 attached thereto and an opening 158 in a table top section 134. In a preferred embodiment, quick-connect fastener 160 includes a shaft 162 having a first end connected to retention coupler 122 and a conically-shaped barb 164 formed in a second end thereof. Barb 164 has tab 166 extending therefrom. Alternatively, quick-connect fastener 160 may include one or more deflectable tabs having a barb formed in an end thereof, the one or more deflectable tabs extendable into opening 158. Tab 166 slidably engages at least one receptacle 168 formed in table top section 134 thereby securing retention coupler 122 and table inlay 130 to table top section 134. As shown in FIG. 11, the at least one receptacle 168 includes a plurality of bosses 168 formed in a side wall 169 of opening 158. Alternatively, a recess may be formed in side wall 169 to receive tab 166 therein. In an alternative embodiment, opening 158 may extend through table top section 134 such that tab 166 engages a ridge formed in a bottom portion 167 of table top section 134. In any case, it is preferred to provide retention couplers 122 with a quick-connect means for interchanging the table inlay 130.

FIG. 12 illustrates a perspective view of exemplary recesses 126 formed in an edge rail 128 of game table 120. A first recess 170 formed in edge rail 128 has an accessory well 171 formed in a bottom thereof for placing game accessories (not shown) therein. For example, recess 170 may include a "w"-shaped accessory well for placing poker chips therein. A variety of accessory wells 171 may be formed in recess 170 and may be shaped to hold a variety of game accessories therein such as poker chips, dice, and cards.

A cover 172 rotatably attaches to edge rail 128 and encloses recess 170 when positioned in a closed position. In this manner, cover 172 encloses game accessories placed in recess 170 such that the game accessories may be stored with game table 120. In this manner, the game accessories can remain with game table 120 when stored or transported to assist in preventing loss or misplacement of the game accessories.

A pair of rotation pins 174, 176 extend from cover 172 and are insertable into corresponding recesses 178, 180 formed in edge rail 128 to provide a rotation axis 182 about which cover 172 rotates. A pair of bosses 184, 186 formed in cover 172 are insertable into corresponding recesses 188, 190, respectively, formed in edge rail 128 to maintain cover 172 in a closed position. A recess 192 formed in edge rail 128 permits an object such as a finger to be inserted under a lip 194 of cover 172 to allow cover 172 rotation from a closed position to an open position.

A second recess 196 may be formed in edge rail 128 to hold objects such as a cup or food items. In this manner, recess 196 provides player positioning of drinks and chips off of play surface 124, improves the flow of the game, and maintains the cleanliness of play surface 124.

Figure 13:
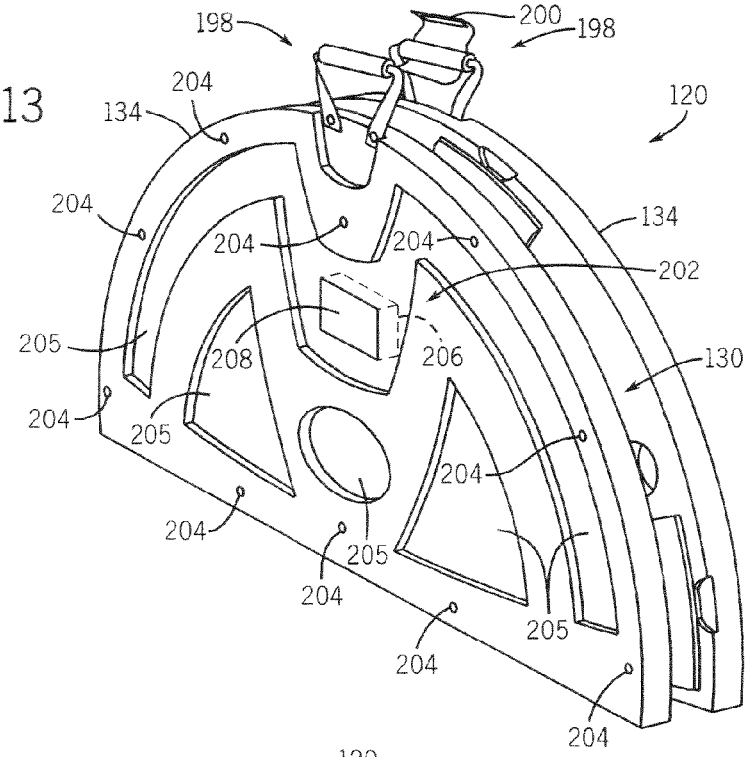
FIG. 13 is a perspective view of the game table of FIG. 8 shown in a collapsed position.

FIG. 13 is a perspective view of the game table of FIG. 8 shown in a collapsed or folded position. Game table 120 folds in an inward fashion. That is, the table top surfaces 144 of table top sections 134 oppose one another when game table 120 is folded in half to protect the table inlay 130. A pair of handles 198 are attached to table top sections 134 for easy and efficient handling of game table 120 in the collapsed position. A strap 200 couples the pair of handles 198 together for efficient handling of the pair of handles 198.

As illustrated by an assortment of depressions 205 formed in the bottom surface 202 of table 120, in one embodiment, table top sections 134 are formed from a plastic material using a blow molding technique. Forming table top sections 134 from plastic creates a lightweight, yet sturdy game table. However, table top sections 134 may be constructed of other processes and materials, such as wood, polypropylene, or recycled materials. The depressions 205 also add strength to bottom surface 202.

A plurality of bosses 204 extend from a bottom surface 202 of game table 120. Bosses 204 are used to raise game table 120 off a supporting surface and, preferably, minimize lateral movement of game table 120 when placed on the supporting surface. Bosses 204 are preferably constructed of a rubber material; however, other suitable materials may be used. Bosses 204 may also be formed in the bottom surface 202 of game table 120 such that bosses 204 are integral to game table 120. For example, bosses 204 may be formed during the blow molding process.

A card storage bin 206 formed in bottom surface 202 allows placement of a deck of cards therein for storing with game table 120. A card storage lid 208 encloses card storage bin 206 and keeps cards placed in card storage bin 206 together with game table 120. Alternatively, a card storage container may be formed in an edge rail 128.

Figure 14:
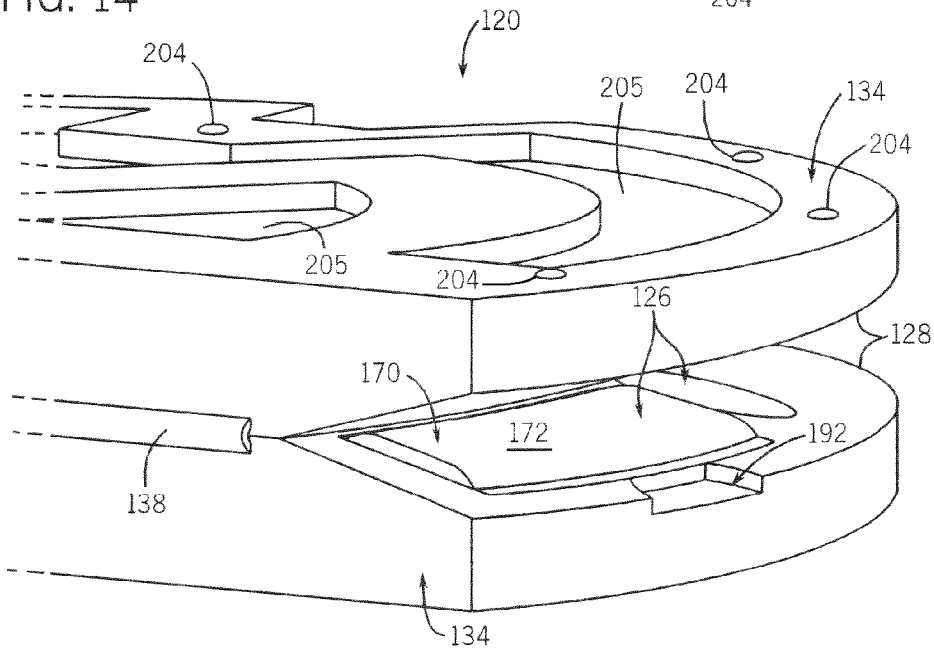
FIG. 14 is an end perspective view of a portion of the game table shown in FIG. 13.

FIG. 14 is an end perspective view of a portion of the game table of FIG. 8 shown in a folded or collapsed position. Cover 172 has a compact profile in the closed position to minimize interference or contact with an opposing edge rail 128. In a preferred embodiment, recesses 170 are positioned in a staggered configuration around edge rail 128 to minimize interference between covers 172 when game table 120 is in a collapsed position. In this manner, covers 172 do not oppose one another when top sections 134 are in a collapsed position.

Game table 120 provides a portable table system having compact storage. Game ancillaries such as poker chips, dice, and cards may be stored with the game table 120 in recesses 170. Covers 172 enclose recesses 170 to keep game ancillaries placed therein with game table 120 to reduce misplacement of the game ancillaries when not in use.

In accordance with one embodiment of the present invention, a folding game table is disclosed that includes a plurality of table top portions and at least one hinge connecting the plurality of table top portions and configured to permit each of the plurality of table top portions to move between an extended position and a folded position. The folding game table also includes at least one table inlay and at least one retention coupler configured to removably attach the at least one table inlay to the plurality of table top portions.

In accordance with another embodiment of the present invention, a table-top apparatus for playing multiple games is disclosed that includes a pair of table sections, means for connecting the pair of table sections to form a foldable table top, and a game mat. The apparatus also includes a coupler assembly engageable about a perimeter of the game mat and constructed to removably secure the game mat to the foldable table top.

In accordance with a yet another embodiment of the present invention, a portable game table includes a first table member and a second table member pivotably attached to the first table member, the first and second table members moveable between an extended position and a collapsed position. A first rail is positioned about an edge of the first table member, and a second rail is positioned about an edge of the second table member. The portable game table includes at least one storage tray formed in at least one of the first rail and the second rail, the at least one storage tray having a lid pivotably attached thereabout, the lid having a closed position and an open position.

The present invention has been described in terms of the preferred embodiment, and it is recognized that equivalents, alternatives, and modifications, aside from those expressly stated, are possible and within the scope of the appending claims.

What is claimed is:

1. A folding game table comprising:

a plurality of table top portions;

at least one hinge connecting the plurality of table top portions and configured to permit each of the plurality of table top portions to move between an extended position and a folded position;

at least one table inlay; and at least one retention coupler configured to removably attach the at least one table inlay to the plurality of table top portions;

wherein the at least one retention coupler is positioned about a periphery of a play surface formed on the plurality of table top portions and has a shape that substantially matches a shape of the play surface.

2. The folding game table of claim 1 further comprising a plurality of fasteners attached to the at least one retention coupler and configured to removably secure the at least one retention coupler to the plurality of table top portions.

3. The folding game table of claim 2 wherein each of the plurality of table top portions includes a plurality of apertures disposed therein, each aperture constructed to receive a respective fastener of the plurality of fasteners therein.

4. The folding game table of claim 3 wherein the at least one table inlay has a plurality of holes formed therein, each hole configured to align with a corresponding aperture of the plurality of apertures and constructed to allow passage of the respective fastener therethrough.

5. The folding game table of claim 3 wherein each aperture has a receptacle formed therein, the receptacle configured to operatively engage the respective fastener.

6. The folding game table of claim 2 wherein each fastener has a first end attached to the at least one retention coupler, and a second end having a barb formed thereat.

7. The folding game table of claim 1 further comprising at least one accessory cavity formed in one of the plurality of table top portions and constructed to receive at least one game accessory therein.

8. The folding game table of claim 7 further comprising a lid pivotably attached to one of the plurality of table top portions and constructed to secure the at least one game accessory within the at least one accessory cavity.

9. The folding game table of claim 7 wherein the at least one game accessory is at least one of a plurality of poker chips, at least one die, and a deck of cards.

10. The folding game table of claim 1 wherein the at least one table inlay is constructed of at least one of a felt material, a leather material, and a vinyl material.

11. The folding game table of claim 1 further comprising a pair of handles attached to any of the plurality of table top portions.

12. The folding game table of claim 1 wherein the plurality of table top portions are constructed of blow molded plastic.

13. A folding game table comprising:

a plurality of table top portions;

at least one hinge connecting the plurality of table top portions and configured to permit each of the plurality of table top portions to move between an extended position and a folded position;

at least one table inlay;

at least one retention coupler configured to removably attach the at least one table inlay to the plurality of table top portions;

a plurality of fasteners attached to the at least one retention coupler and configured to removably secure the at least one retention coupler to the plurality of table top portions;

wherein each of the plurality of table top portions includes a plurality of apertures disposed therein, each aperture constructed to receive a respective fastener of the plurality of fasteners therein; and wherein the at least one table inlay has a plurality of holes formed therein, each hole configured to align with a corresponding aperture of the plurality of apertures and constructed to allow passage of the respective fastener therethrough.

* * * * *